US007429140B2

(12) United States Patent
Demellier

(10) Patent No.: US 7,429,140 B2
(45) Date of Patent: Sep. 30, 2008

(54) CASE ASSEMBLY FOR LIPSTICK AND ASSOCIATED CLOSURE CAP

(75) Inventor: Stéphane Demellier, Angon (FR)

(73) Assignee: DJ Pack (FR)

( * ) Notice: Subject to any disclaimer, the term of this patent is extended or adjusted under 35 U.S.C. 154(b) by 541 days.

(21) Appl. No.: 11/157,178

(22) Filed: Jun. 21, 2005

(65) Prior Publication Data

US 2006/0285911 A1 Dec. 21, 2006

(51) Int. Cl.
*A45D 40/00* (2006.01)

(52) U.S. Cl. ..... 401/98; 401/262

(58) Field of Classification Search ..... 401/98, 401/131, 102, 110–112, 202, 262; 206/385
See application file for complete search history.

(56) References Cited

U.S. PATENT DOCUMENTS 6,068,421 A * 5/2000 Pierpont ..... 401/78
6,231,255 B1 * 5/2001 Tsai ..... 401/78
6,457,223 B1 * 10/2002 Breton et al. ..... 29/417

* cited by examiner

*Primary Examiner*—David J Walczak
(74) *Attorney, Agent, or Firm*—Hershkovitz & Associates, LLC; Abe Hershkovitz

(57) ABSTRACT

A case assembly, rotating or non-rotating, containing a cosmetic product such as lipstick, and a closure cap associated with that case by way of complementary attachment and release mechanisms, wherein the rotating case as well as the attachment and release mechanisms for the cap are completely integrated into the latter; and the attachment and release mechanisms are constituted by a hollow piston, movable in translation, disposed concentrically in the bore of the cap and capable of sliding therein, the hollow piston itself having a bore in which the case carrying the lipstick is housed and secured at one end by way of a removable attachment mechanism, the piston furthermore having a locking and unlocking mechanism interposed between the piston and the cap and acting in one direction or the other by axial pressure exerted simultaneously on the cap and on the visible surface of a base of the integrated case, which base is in contact with the piston, so as to cause release, with respect to the cap, of the piston and hence of the case which is secured therein, and make the base of the case graspable by a user in order to remove it.

6 Claims, 3 Drawing Sheets

CASE ASSEMBLY FOR LIPSTICK AND ASSOCIATED CLOSURE CAP

BACKGROUND OF THE INVENTION

1. Field of the Invention

The present invention concerns a case assembly, rotating or non-rotating, containing a cosmetic product such as lipstick, and a closure cap associated with that case by way of complementary attachment and release means.

2. Discussion of Background Information

In known assemblies of this type, generally containing a lipstick, the closure cap clicks into place on an upper part of the base of the case, consequently leaving the latter visible.

Not only is it not very attractive to see the base of the case projecting beyond the cap, but that base moreover generally serves to exert a rotational action acting on the cosmetic product, in this instance the lipstick, which can thus deteriorate inside the case.

SUMMARY OF THE INVENTION

According to a first phase of the inventive approach, the concept was to integrate the case, including the base, into the cap.

But a problem then arose because it became impossible to grasp the base of the case in any way in order extract the latter from the cap; and this then became the problem to be solved, namely to make the lipstick case extractable when it is entirely integrated into the cap.

The present invention concerns, for this purpose, a case assembly, rotating or non-rotating, containing a cosmetic product such as lipstick, and a closure cap associated with that case by way of complementary attachment and release means, wherein the rotating case as well as the attachment and release means for the cap are completely integrated into the latter; and those means are constituted by a hollow piston, movable in translation, disposed concentrically in the bore of the cap and capable of sliding therein, the hollow piston itself having a bore in which the case carrying the lipstick is housed and secured at one end by way of removable attachment means, the piston furthermore having a locking and unlocking mechanism interposed between said piston and the cap and acting in one direction or the other by axial pressure exerted simultaneously on the cap and on the visible surface of a base of the integrated case, which base is in contact with the piston, so as to cause release, with respect to the cap, of said piston and hence of the case which is secured therein, and make said base of the case graspable by a user in order to remove it.

The present invention also concerns the characteristics which will become apparent in the course of the description that follows, and which will need to be considered individually or in accordance with all their possible technical combinations.

BRIEF DESCRIPTION OF THE DRAWINGS

This description, given as a non-limiting example, will make more evident the manner in which the invention can be carried out, referring to the attached drawings in which.

DETAILED DESCRIPTION OF THE PRESENT INVENTION

Figure 1:
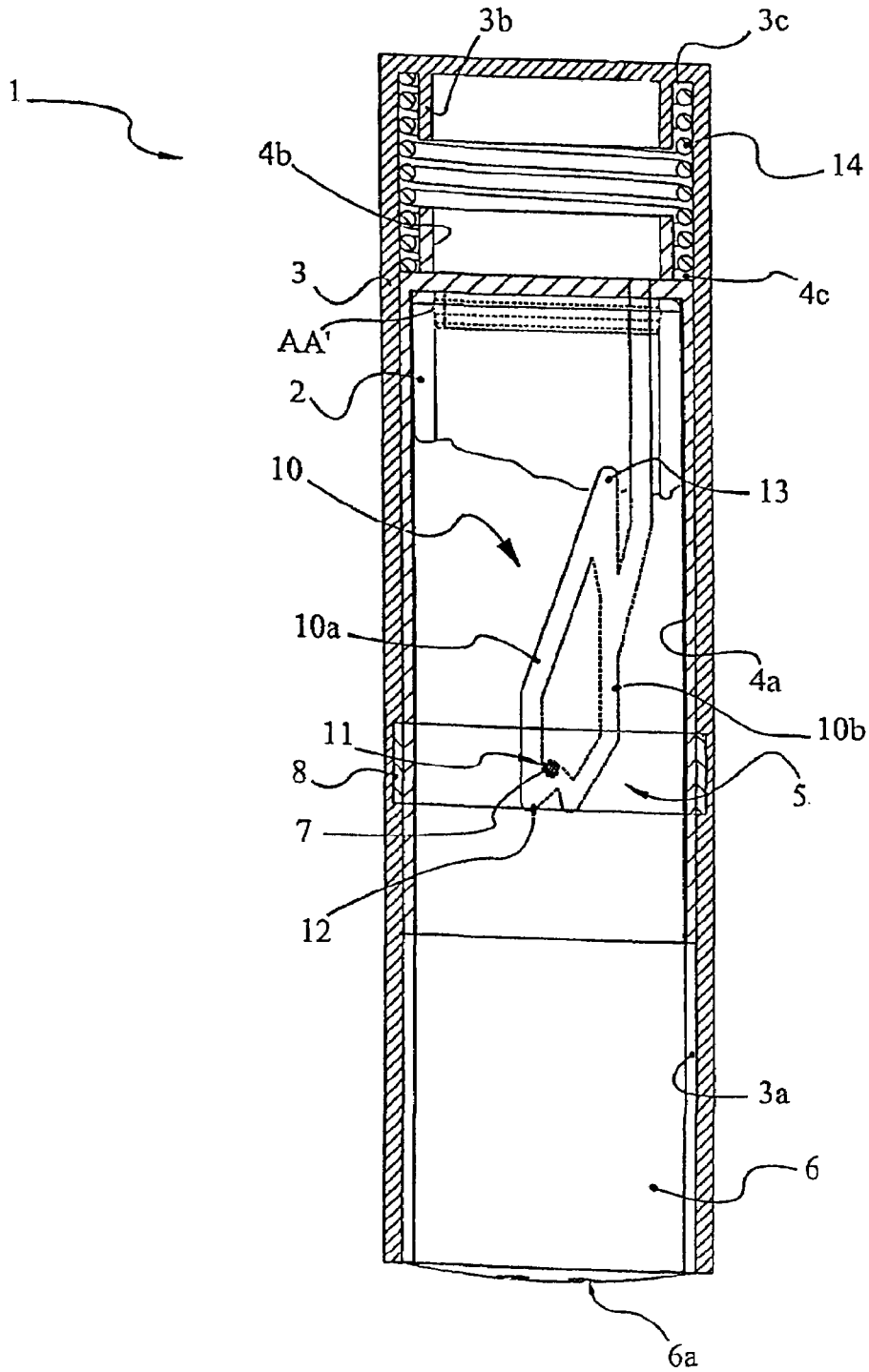
FIG. 1 is a longitudinal sectioned view of a case assembly according to the present invention in the retracted position.
Figure 2:
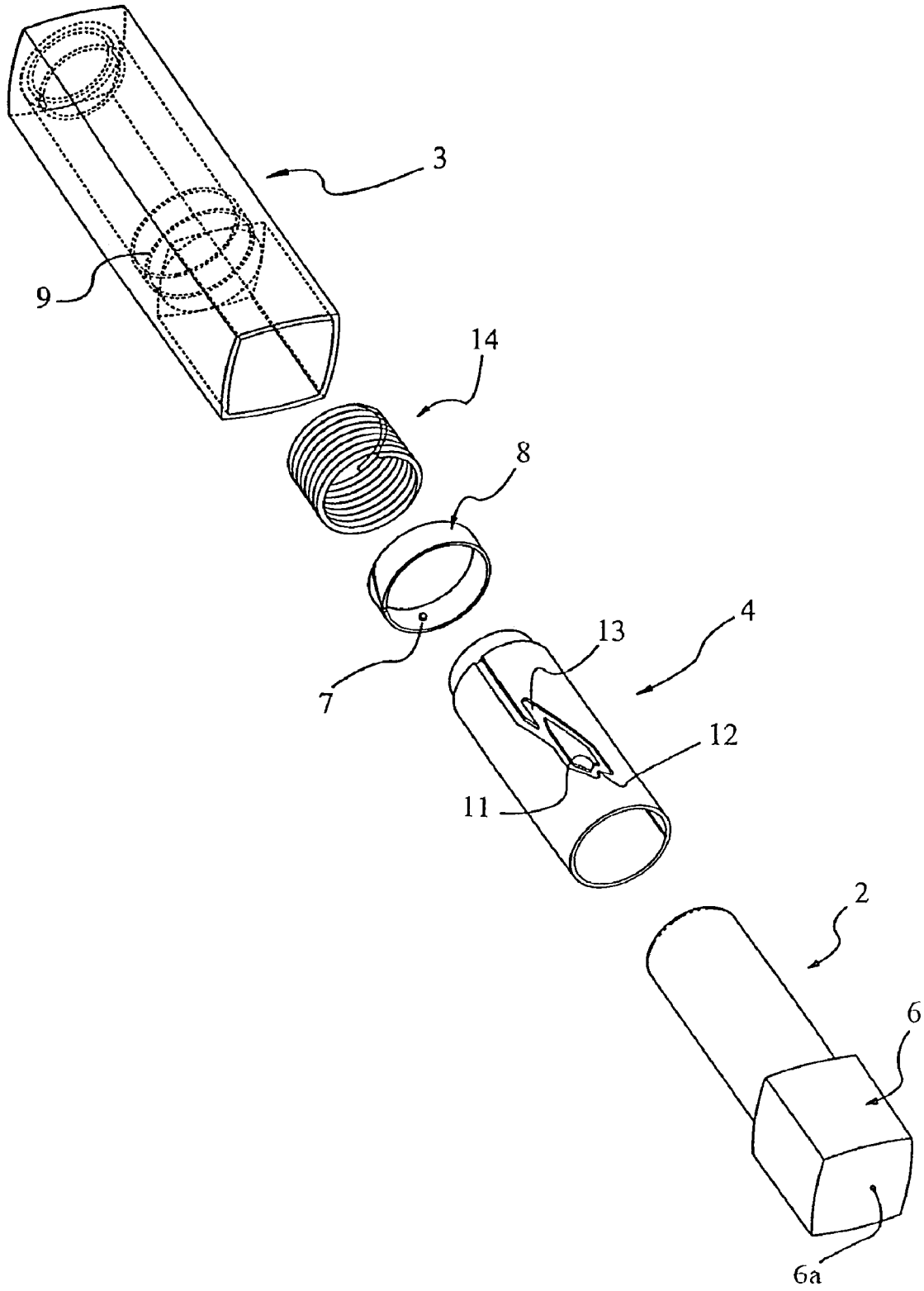
FIG. 2 is an exploded perspective view of the assembly according to FIG. 1.
Figure 6:
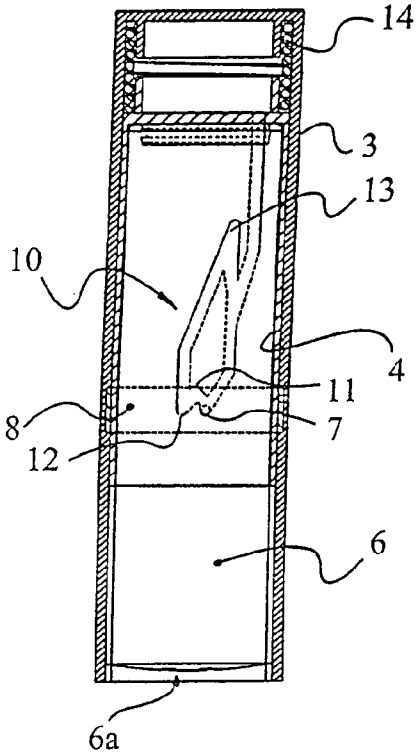
FIGS. 3, 4, 5, 6 depict an assembly according to FIG. 1, respectively with the cap closed; after disengagement of the cap opening; with the cap open; and after engagement of the closed position.
Figure 5:
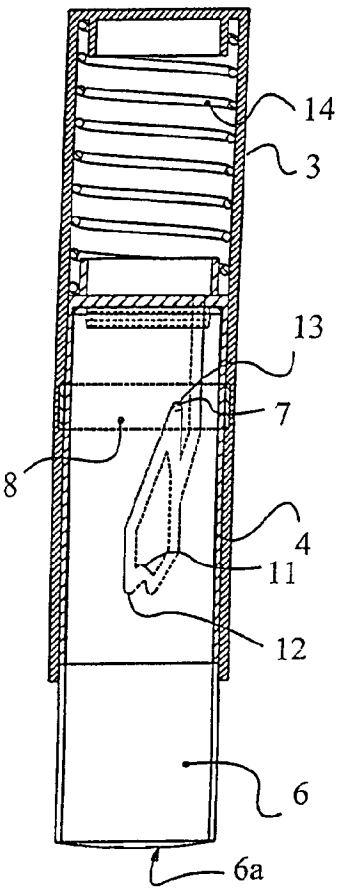
Figure 4:
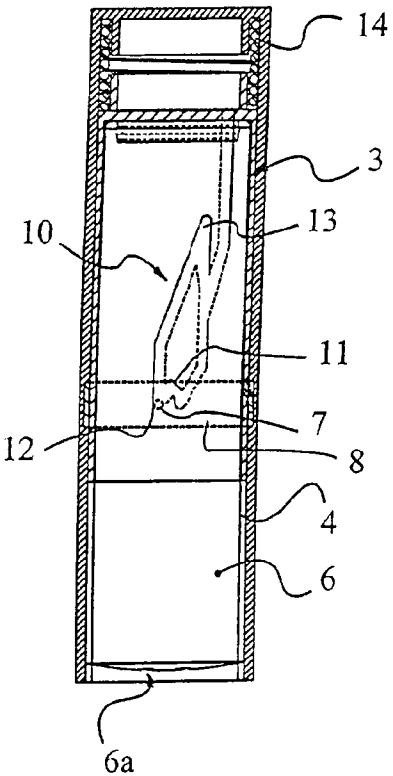
Figure 3:
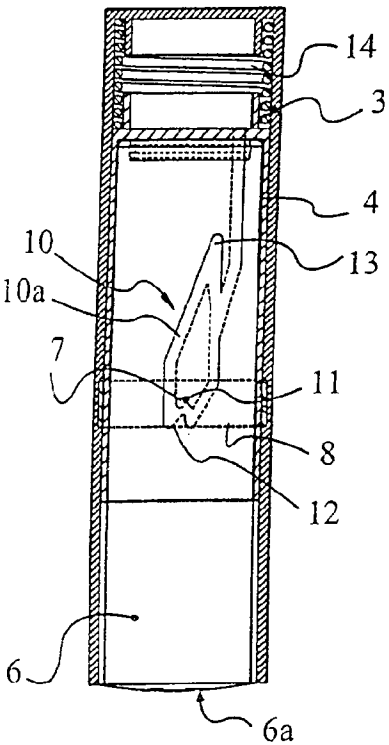

Assembly 1 globally designated in the Figures comprises a case 2, rotating or non-rotating, containing a cosmetic product such as lipstick (not depicted), and a closure cap 3 associated with case 2 by way of complementary attachment and release means.

According to the invention, rotating case 2, as well as the attachment and release means of cap 3, are entirely integrated into the latter. Those means are constituted by a hollow piston 4, movable in translation, disposed concentrically in bore 3*a* of cap 3. Piston 4 is capable of sliding in the latter. Said hollow piston 4 itself has a bore 4*a* in which case 2 carrying the lipstick is housed and secured at one end by way of removable attachment means A, A'. Piston 4 furthermore has a locking and unlocking mechanism 5 interposed between said piston 4 and cap 3 and acting in one direction or the other by axial pressure exerted simultaneously onto cap 3 and onto visible surface 6*a* of a base 6 of the integrated case 2, which base 6 is in contact with piston 4. The result is to cause release, with respect to cap 3, of said piston 4 and hence of case 2 which is secured therein, to make said base 6 of case 2 graspable by a user in order to remove it.

According to the present exemplifying embodiment, locking and unlocking mechanism 5 of piston 4, and thus of case 2 which is secured therein, with respect to cap 3 is constituted on the one hand by a pin 7 integral with a rotating flange 8 that is fixed in translation with respect to cap 3 and housed in a corresponding channel 9 thereof. It is constituted on the other hand by a double ramp 10 which is recessed into the wall of piston 4 and whose branches 10*a*, 10*b* that form it define, at a first end-located junction point, a receptacle 11 intended for pin 7 of rotating flange 8. With a slight pressure on piston 4 and relaxation of that pressure in order to unlock it, pin 7 escapes from receptacle 11 and comes into contact with an inclined region 12 located between branches l0*a*, l0*b* of double ramp 10, thus causing pin 7, and consequently flange 8, to rotate. Said pin 7 is then free to slide in one l0*a* of the branches of double ramp 10 as far as a second junction point of branches 10*a*, l0*b* defined by a receptacle 13 opposite the first one 11, actuated by an elastic element 14 interposed between bottom of cap 3 and bottom of piston 4. This results in the ejection of piston 4 and hence of case 2 and its base 6 so that the latter can be grasped. Relocking can be brought about by introducing case 2 into piston 4 that slides into cap 3 which has remained in the unlocked position, and by exerting a pressure on piston 4 by way of base 6 of case 2, forcing pin 7 of rotating flange 8 to slide into the other branch l0*b* of double ramp 10 until it engages again into receptacle 11 formed by branches l0*a*, l0*b* of double ramp 10.

According to another characteristic of the invention, pusher spring 14 of piston 4 is installed compressedly between bottom of cap 3 and bottom of piston 4, by way of a first concentric guide 3*b* projecting from the internal bottom of cap 3 and a second concentric guide 4*b* projecting from the outer bottom of piston 4, delimiting between them respective annular receptacles 3*c*, 4*c*.

In addition, removable mounting of case 2 on piston 4 is brought about by way of a channel A present on the elastically deformable inner periphery of the end of case 2 opposite its base 6, and a complementary annular protrusion A' present on an internal shaft projecting from the bottom of piston 4.

The invention claimed is:

1. A case assembly, containing a cosmetic product, and a closure cap associated with that case by way of complementary attachment and release means, wherein the case as well as the attachment and release means for the cap are completely integrated into the cap; and those means are constituted by a hollow piston, movable in translation, disposed concentrically in a bore of the cap and capable of sliding therein, the hollow piston having a bore in which the case carrying the cosmetic product is housed and secured at one end by way of removable attachment means, the piston furthermore having a locking and unlocking mechanism interposed between said piston and the cap and movable in opposite directions by axial pressure exerted simultaneously on the cap and on a visible surface of a base of the integrated case, which base is in contact with the piston, so as to cause release, of said piston and the case, and enable said base of the case to extend from said cap to thereby be graspable by a user in order to remove said case.

2. The assembly according to claim 1, wherein the locking and unlocking mechanism of the piston, and the case which is secured therein, with respect to the cap is constituted by a pin integral with a rotating flange that is fixed in translation with respect to the cap and housed in a corresponding channel, and by a double ramp which is recessed into the wall of the piston, branches that form said double ramp define, at a first end-located junction point, a receptacle intended for the pin of the rotating flange which, with a slight pressure on the piston and a subsequent relaxation in order to unlock said piston, escapes and comes into contact with an inclined region located between the branches of the double ramp, thus causing the pin, and consequently the flange, to rotate, said pin then being free to slide in one of the branches of the double ramp as far as a second junction point of the branches defining a receptacle opposite the first receptacle (11), actuated by an elastic element interposed between the bottom of the cap and the bottom of the piston, thus achieving ejection of the piston and the case and said base so that the base can be grasped, relocking being brought about by introducing the case into the piston that slides into the cap which has remained in an unlocked position, and by exerting a pressure on the piston by way of the base of the case, forcing the pin of the rotating flange to slide into the other branch of the double ramp until said pin engages again into the receptacle formed by the branches of the double ramp.

3. The assembly according to claim 2, wherein removable mounting of the case within said piston is brought about by way of a channel present on an elastically deformable inner periphery of the end of the case opposite said base, and a complementary annular protrusion present on an internal shaft projecting from the bottom of the piston.

4. The assembly according to claim 2, wherein said elastic element comprises a pusher spring installed compressedly between the bottom of the cap and the bottom of the piston, by way of a first concentric guide projecting from the internal bottom of the cap and a second concentric guide projecting from the outer bottom of the piston, delimiting between them respective annular receptacles.

5. The assembly according to claim 4, wherein removable mounting of the case within said piston is brought about by way of a channel present on an elastically deformable inner periphery of the end of the case opposite said base, and a complementary annular protrusion present on an internal shaft projecting from the bottom of the piston.

6. The assembly according to claim 1, wherein removable mounting of the case within said piston is brought about by way of a channel present on an elastically deformable inner periphery of the end of the case opposite said base and a complementary annular protrusion present on an internal shaft projecting from the bottom of the piston.

* * * * *